US007740296B2

(12) United States Patent
DaVia

(10) Patent No.: US 7,740,296 B2
(45) Date of Patent: Jun. 22, 2010

(54) GUTTER CLEANING APPARATUS

(76) Inventor: Paul C. DaVia, 1702 Woodmill St., Chesapeake, VA (US) 23320

( * ) Notice: Subject to any disclaimer, the term of this patent is extended or adjusted under 35 U.S.C. 154(b) by 0 days.

(21) Appl. No.: 12/214,926

(22) Filed: Jun. 24, 2008

(65) Prior Publication Data

US 2009/0315354 A1 Dec. 24, 2009

(51) Int. Cl.
*E04D 13/076* (2006.01)

(52) U.S. Cl. ..... 294/19.1; 294/104; 15/236.04

(58) Field of Classification Search ..... 294/19.1, 294/104, 111; 56/333; 15/236.04
See application file for complete search history.

(56) References Cited

U.S. PATENT DOCUMENTS 3,743,339 A * 7/1973 Brackett ..... 294/19.1
4,114,938 A * 9/1978 Strader ..... 294/19.1
4,192,539 A * 3/1980 Broyles et al. ..... 294/19.1
5,853,209 A * 12/1998 McDermott ..... 294/19.1
5,855,402 A * 1/1999 Maraschiello ..... 294/19.1
5,941,586 A * 8/1999 Fann ..... 294/19.1
6,139,077 A * 10/2000 Molzan, II ..... 294/19.1
6,209,937 B1 * 4/2001 Keiter ..... 294/19.1
6,227,584 B1 * 5/2001 Reuther ..... 294/19.1

* cited by examiner

*Primary Examiner*—Dean J Kramer
(74) *Attorney, Agent, or Firm*—Bradley D. Goldizen

(57) ABSTRACT

A gutter cleaning apparatus includes a pair of opposing reverse curved blades biased open and connected together at upper edges by spring hinges. A fixed blade attaches to an extendible pole. A movable blade includes a lever arm fixed to an end of a rope that extends down the axis of the pole to the user's hand. During operation, the end of the pole with the attached apparatus is lifted over the gutter; the blades are lowered into the gutter sidewalls, and slid along the gutter trough to pile up debris. The apparatus, with open blades, is lifted over the pile and lowered into the debris. The rope is then pulled taut to close the blades and grasp the debris. The apparatus and debris are lifted from the gutter. Tension on the rope is slackened to release the debris that falls to the ground for collection and disposal.

26 Claims, 9 Drawing Sheets

GUTTER CLEANING APPARATUS

There are no related patent applications.

The present application did not receive any federal research and/or development funding.

TECHNICAL FIELD

Generally, the present invention relates to a lightweight, easily operable, rain gutter cleaning apparatus attached to an extendible pole. The apparatus includes a rope or cord for actuating a unique pair of blades that comprise operating jaws that surround, grasp and remove debris such as leaves, pine needles, pine cones, stones, and rubber balls that typically clog a roof rain gutter. More particularly, the present invention is a lightweight gutter cleaning device that includes a pair of opposing blades arranged at one end of a generic extendible pole at an optimal angle allowing for insertion of the blades into a roof rain gutter trough while standing at ground level. Operation of the device includes holding the extendible pole such that the free edges of the open blades are inserted between the sidewalls of a gutter. That is, the blades are lowered into the debris and closed to encapsulate and collect the debris therein. The user pulls on an actuator rope to close the cleaning apparatus blades around debris in the gutter. The debris laden apparatus is lifted and removed from the gutter and the rope tension is released to discharge the debris from the apparatus to the ground for easy disposal.

Rain gutter cleaning device elements include: a generic fiberglass or non-conductive extendible pole with a male threaded end; the invention is attached to the pole via a fixed blade having a female threaded opening; a thumb screw is provided in the sidewall of the device, the thumb screw tightening against the pole threads to prevent rotation of the device during use; an opposing moveable blade attached to the fixed blade with a pair of spring loaded hinges that tend to bias the fixed blade and the moveable blade towards an open position; a lever arm is provided on the exterior side of the moveable blade, said lever arm having an opening for receiving an end of a rope; said rope knotted at the lever opening to prevent pull-through; slackening or tightening said rope serves as the device actuator to open and close the movable blade end toward the fixed blade, thereby grasping the debris that is clogging a gutter, lifting the debris out of the gutter and then releasing it to fall to the ground for easy disposal; actuator rope is composed of polypropylene or nylon for non-absorbent properties; blades and hinges are composed of electrically non-conductive materials.

Operation of the present invention requires virtually no setup and no adjustment. The gutter cleaner is simply attached to the male threaded end of a generic fiberglass extension pole which is then adjusted in length to suit the gutter height from the ground. Moving to a gutter at a different height requires only extending-or shortening the length of the pole. The gutter cleaning device of the present invention includes a preferred pre-set angle formed between the longitudinal axis of the blade faces and the axis of the pole that determines the user set-back distance from gutter. This angle is optimized for gutter heights varying from one to two stories (10 ft to 20 ft) and facilitates a balanced and ergonomically comfortable stand-off distance during pickup and discharge of gutter debris. When operating the device at the normal gutter set-back distance, a 90 degree angle between the longitudinal axes of blades and the lateral bottom edge of the blades permits flush contact of blades along the bottom of gutter. This results in a more complete pickup of debris and a faster gutter cleaning operation.

Another pre-set angle of the blades in relation to vertical facilitates debris to be easily pushed under and to the opposite side of the gutter support strap or nail. Opposing reverse "S" curve shapes of the blades impart a high pick-up efficiency and capacity for a wide range of gutter debris including pine needles, pine cones, and leaves in both a dry or wet state. A raised ridge, running longitudinally at the center of each blade, reinforces the blades and prevents excessive flexing of the blades and increases their grasping strength. The blades are preferably formed from non-metallic composite, Nylon or a plastic compound and are provided with pre-marked trim lines to allow them to be trimmed in width to accommodate an unusually narrow opening between the shingle overlap into gutter and the front edge of the gutter. In this manner, the width of the gutter cleaning device may be easily manipulated for use with a uniquely shaped guttering. The blades' bottom edges may also be trimmed to accommodate gutters with a rounded bottom. This allows blades to be inserted flush with the bottom of the gutter to assure that a large volume of debris may be withdrawn from the gutter in one operation of the device.

The high grasping pressure and juxtaposed angles of the blade tips facilitates easy pickup and removal of heavy or round objects such as stones and tennis balls which are often half or more embedded in the gutter downspout opening. The device is constructed to maintain a clear space between the blades to prevent any parts from interfering with the debris removal process. The opening between the two grasping blades contains no cords, wires, springs or other mechanical components which may cause interference or entanglement during pickup of debris. The light weight of unit facilitates ease of use, particularly for two story gutters. The unit is strong enough to be temporarily hung on the gutter with pole attached during rest period or to attend to something during the cleaning.

BACKGROUND OF THE INVENTION

Roof eave mounted rain gutters with attached downspouts are installed at the eave fascia just below the over-hanging shingles on most sloped roof buildings. Gutters are generally an open box shape with a flat or rounded bottom and are made of sheet metal, plastic or wood. The roof runoff water collects in the slightly sloped gutters toward and into regularly spaced vertical downspouts connected to the bottom of the gutter whereupon the water is directed on the ground level away from the base of the structure. Gutters are installed on buildings to protect and preserve the siding, windows, and foundation of the structure from rain water damage. Water collecting at the foundation area is particularly damaging and may cause settling or shifting of the structural support of the building. Rain, in prolonged contact with exterior siding, masonry and windows often causes cracks, mildew and wood rot or decay. Gutters are most commonly fastened by long nails driven through the top edge of the gutter into the fascia or by straps that are clipped to the front of the gutter and then fastened by screws into the fascia board. The nails or straps are typically spaced at three to six foot intervals along the gutter. Problems arise with proper operation of gutters when vegetation, twigs, bark, branches, or other debris enters the gutter trough and slows or prevents the movement of water to the downspouts. The clogged gutters will then overflow onto the siding, windows and foundation causing water damage to the structure and rendering the gutters useless. The problem of how to keep gutters clean and properly operating becomes a major concern. Commercial gutter cleaning services rapidly become very expensive because gutters often fill with debris several times a month, usually in Autumn and Summer and when trees shed and when winds from storms tend to generate debris.

At present, homeowners who clean gutters themselves most commonly use a ladder to remove debris by hand. This process requires repetitiously repositioning the ladder to clean several feet of the gutter at a time. This is a dangerous task as falling from a ladder may result in serious injury or death. Even more dangerous is gutter cleaning performed by standing on the edge of the roof and leaning over the gutter to remove the debris.

In an attempt to combat the aforementioned problems, prior art have arranged screens or screening material on the open top of the trough to prevent debris from entering the gutter. This solution is often ineffective when pine needles or leaves quickly clog the screen openings. Others have attempted to overcome the problem by designing specially made gutters that include caps or hoods. A narrow slot is provided along the outer edge to allow entry of water into the gutter. Drawbacks associated with these specially made gutters are that they cost much more than conventional gutters, are substantially heavier, and tend to overflow under severe rain conditions.

Other prior art inventions have attempted remote or ground level gutter debris removal with little practical success because of many shortfalls and deficiencies in the gutter cleaning devices. Some of the defects and deficiencies of the prior art include: excessive complexity of the device, high manufacture costs, inappropriate structural components, operational design flaws, non-ergonomic operation, inefficient operation and a general inability of the user to adapt the device to actual conditions encountered.

Some gutter cleaning devices have used extension pipes and hoses to remove debris with air or water pressure. Devices of this type are extremely impractical, in that they have limited reach due to their weight and often spread the gutter debris and water over the user, the siding and the roof. Moreover, they are incapable of removing heavy debris and may injure the user from debris propelled from the gutter by the air or water pressure.

Some prior art devices comprise hand operated scoops, rakes or brushes that require use of a ladder with the associated dangers previously mentioned. The cleaning process with these devices is extremely slow and inefficient because the ladder must be repeatedly repositioned.

Prior art devices having mechanisms with grabbers that operate perpendicular to the longitudinal gutter axis do not work because of the very narrow space, (often as little as 2 inches) between the shingle overhang and the front of the gutter. In this respect, prior art devices fail to allow for adjustment of the grasper width and motion to accommodate varying gutter openings of varying widths. Moreover, the bottom edges of some devices cannot reach or do not maintain flush contact with the bottom of the gutter resulting in inefficient debris pick-up. Thus, the debris left over the entire length of the gutter may be swept together to create another clog during a successive rain event.

Flat blade graspers seen in some prior art are limited in the amount of debris that can be held and are therefore inefficient to use. Grasper systems that have mechanisms, wires or cords arranged within the grasper closure area are subject to wear and to becoming so fouled or tangled in the debris as to render the system inoperable. These types of devices may require frequent cleaning during operation. Thus, they must be systematically returned to ground level and cleaned.

Other prior art grasper or paddle devices fail to solve the problem of easily pushing gutter debris under the gutter support straps, nails or other gutter fasteners without having to awkwardly tip the pole to effect a proper angle under the gutter fastener.

With regard to extendible poles, prior art devices that require specially made poles with actuator levers or adapters become impractical due to their high weight, high cost and limited reach. In the same manner, some gutter cleaning devices are rendered impractical because of the complexity requiring expensive machine fit components and the inability of the user to effect simple, low cost repairs with common household tools. Moreover, the embodiment of many prior art devices requires construction made of conductive metal or a predominantly metal combination which has danger of electrical contact with proximate electrically energized conductors. Still other heavy devices would cause rapid user fatigue because of the cantilever effect that magnifies the weight.

Prior art devices that do not provide for a proper stand-off from the gutter would position the user too close beneath the gutter for safety or ergonomic operation. Insufficient stand-off may also allow these devices to be chaffed by the front face of the gutter during use.

SUMMARY OF THE INVENTION

It is an overall objective of the present invention to disclose an attractive looking, lightweight, inexpensive, easily repaired, non-metallic tool or device that, when attached to a common fiberglass extension pole will facilitate a person, standing at ground level, to quickly, easily and safely clean eave mounted rain gutters located at a height of one or two stories above ground (8 ft to 20 ft). The design of the present invention includes blades that comprise smooth, clean external surfaces to reduce fowling of unit by debris. An objective of the present invention is to teach an inexpensive and intuitively operated device or tool that facilitates a person in cleaning a gutter from the ground level in a safe, economical and efficient manner. The present invention, a gutter cleaner, wholly satisfies both the gutter cleaning objectives and the deficiencies of prior art. The present invention is inexpensive to fabricate, very durable, yet easily repaired using common household tools. The device is ergonomically designed for ease of operation in removing wet or dry debris such as leaves, pine needles, pine cones and stones, as well as recreational balls and toys that commonly clog rain gutters and downspout openings. The present invention allows a user standing at ground level to remove and deposit gutter debris to the ground for easy pickup and disposal. The present invention is inexpensive to fabricate, durable yet easily repaired using common tools. Moreover, the present invention removes debris such as leaves, pine needles, pine cones and stones, as well as recreational balls that commonly clog rain gutters and will deposit the debris to the ground for easy pickup and disposal.

The present invention is a lightweight, easily operable gutter cleaning apparatus that includes a rope or cord for actuating the extendible cleaning apparatus to open and close a pair of blades that comprise grasping ends or jaws. The gutter cleaning device includes a pair of opposing blades arranged at one end of an extendible pole, the blades being arranged at an optimal angle with the pole to provide a safe and ergonomically comfortable set-back from the gutter while operating from the ground below. The fixed blade includes a female screw receptacle for accepting the male screw end of an extendible pole and is fixed relative thereto. The other blade is movable and rotates relative to the fixed blade. The movable blade has an extension or lever at the pole end of the blade. The extension or lever protrudes an optimal two (2) to four (4) inches from the blade face to provide mechanical advantage when pulling the blade actuator rope. An opening is located at the outer end of the extension or lever to which the blade actuator rope or cord is attached. The working ends of the blades are formed in the shape of an "S" curve when viewed from the sides. Blade edges are scored or marked to be easily trimmed to fit within a narrower gutter opening between the roof shingles and the front edge of the gutter should it be necessary. The device and blades are constructed to be resilient yet strong and preferably formed from lightweight non-metallic composite, Nylon, or plastic material. The interior cavity formed by the opposing "S" curve of the blades forms a bulbous space between the blades. This space allows for increased pickup efficiency when grasping debris to lift it from within the gutter It is an object of the invention to teach a tool or device that is lightweight, intuitively operated, inexpensive, easily repaired, non-metallic, and electrically insulated that may be arranged at one end of a fiberglass extendible pole for removing debris from a rain gutter. The device facilitates a person, standing at ground level, to quickly and safely clean eave mounted rain gutters located at a height of one or two stories or eight (8) to twenty (20) feet above ground level.

It is an object of the invention to teach an apparatus having a simplified design that requires a fixed blade having an attachment receptacle for an extendible pole and having a moveable blade coupled to the fixed blade by means of a spring hinge or hinges attached to the blades using common fasteners such as non-corrosive bolts, nuts, and washers. This simplified design allows for easy repair or blade replacement using common household tools.

It is an object of the invention to teach an apparatus in which the fixed blade component has a female threaded receptacle in which to attach the male threaded end of a generic fiberglass extension pole. To prevent loosening of the apparatus from the pole, a thumb-screw is provided at the side of the fixed blade female thread, tightening into the pole male threads of the pole.

It is an object of the invention to teach a rain gutter cleaning apparatus that is easily operated by a user from the ground level requiring virtually no setup and no adjustment. The gutter cleaner is simply attached to the male threaded end of an extendible fiberglass pole which is then set in length to suit the gutter height from the ground. Moving to a gutter at a different height requires only extension or shortening of the extendible pole.

In a preferred embodiment, when viewed from front or back, a pre-set angle of twenty (20) to twenty-five (25) degrees between the longitudinal axis of blades and the pole determines the user set-back distance from the gutter. This angle is optimized for gutter heights varying from one to two stories, typically between eight (8) and twenty (20) feet from ground level and facilitates a balanced and ergonomically comfortable stand-off distance during pickup and discharge of gutter debris.

When operating the device at the preset stand-back from the gutter, the bottom edges of the blades will be essentially horizontal, allowing full flush contact of the blades along the bottom of the gutter. Full blade contact with the bottom of the gutter allows for more complete pickup of debris and a faster cleaning operation.

A pre-set angle of seven (7) to twelve (12) degrees between the blades in relation to the pole, as viewed from the sides, facilitates debris to be easily pushed under and to the opposite side of the gutter support strap or nail. The "S" curve shape of the operating ends of the blades imparts added blade rigidity and an efficient and high pick-up capacity for a wide range of gutter debris including pine needles, pine cones, and leaves in both a dry or wet state. A raised stiffener ridge running longitudinally at the center of each blade reinforces the lightweight material to prevent excessive flexing of the blades while increasing the grasping strength of the blades. The pair of blades are connected by at least one spring-biased hinge, preferably a pair of spring-biased hinges. The hinges may be formed from acrylic or plastic spring hinges that bias the pair of blades towards an open position.

It is a further object of the invention to teach a gutter cleaning apparatus in which the open position between blades is maintained at an optimum of thirty-five (35) to forty-five (45) degrees relative to each other by means of limiting spring hinges or by blade stop extensions. The blade stop extensions comprise opposing raised beveled edges arranged along the top of each blade.

The present invention facilitates completion of gutter cleaning operations quickly and efficiently with minimal setup only requiring the operator to connect the gutter cleaner to a commercially available extension pole. Moreover, operation of the device requires no special training or complicated instruction. It is constructed of lightweight material to permit use without the operator experiencing undue fatigue. The present invention comprises nonconductive material to reduce the risk of electrical shock should the device inadvertently contact overhead electrical lines. The materials used in creating the blades are durable and will not rust or corrode. The instant invention does not require the dangerous use of a ladder for operation.

Additionally, the present invention attaches, with no special adapter, to a commercially available fiberglass extension pole having a male threaded end. The instant invention has a smooth, pleasing overall appearance with no sharp edges, promoting safety and easy cleaning. The device allows for temporarily stopping the cleaning operation and then quickly resuming the process. Moreover, it can be quickly repaired by the user, as any of it's few parts may be repaired or replaced with use of only a screwdriver and a pair of pliers.

The gutter cleaning device maintains a clear space between the grasping blades or tongs with no cord or mechanism near or in contact with the debris to prevent interference, wear and fouling. It advantageously provides a means of reducing the width of the grasping blades to customize them to suit local conditions and prevent interference with shingle overhang into the gutter. Further, it has an optimized pre-set angle of the blades in relation to the pole axis to provide an ergonomically comfortable set-back from the gutter and to maintain the bottom edges of the blades in flush contact with the bottom of the gutter trough.

The present invention includes a pre-set angle of the blades in relation to the pole axis that is optimized to facilitate pushing debris under the gutter support straps or nails. A stiffener ridge at each blade strengthens the blades to prevent excessive flexure and allow sufficient pressure between blades to grasp heavy debris that may be solidly lodged within the gutter. Serrated edges at the bottom of each blade to assist in loosening hardened debris at the bottom of the gutter.

The blades are designed to use an opposing reverse curves shape to increase quantity of debris pick-up while maintaining the angle required to push debris under the gutter support straps or nails and blade rigidity. The device has juxtaposed lower blade edges that meet when closed to allow edges to grasp and remove an object partially lodged in the downspout opening. A common clothesline or polypropylene rope may be used to hand actuate the grasping blades. Said actuator rope is composed of non-absorbent polypropylene or nylon and is attached to the device off-set from the gutter to prevent wear and entanglement and to closely follow the pole axis for ease of operation.

The device has grasping blades biased in the open position to allow intuitive operation such that tightening the actuator rope closes and tightens the blades around the debris and loosening the rope opens the blades to loosen the grasp and release the debris.

In the preferred embodiment, non-metallic composite, Nylon or plastic blades are provided with pre-marked or scored trim lines to allow blades to be reduced in width so as to accommodate a narrow opening between the shingle overlap into gutter and the front edge of the gutter. The blades are preferably formed by a molding or extruding process such that all parts are formed with smooth lines. The bottom edges of the blades may also be trimmed to accommodate gutters with a rounded bottom allowing the blades to be inserted flush with the bottom of the gutter. The blades may be easily trimmed using a utility knife or shears. It is a further object of the invention to teach a gutter cleaning apparatus that exerts high grasping pressure with juxtaposed and touching blade tips that facilitate easy pickup and removal of heavy or round objects such as stones and tennis balls which are often half or more embedded in the gutter downspout opening. High grasping pressure is effected by means of mechanical advantage from the lever extension on the movable blade to which the actuator rope is attached. Grasping pressure and ability to pick up round debris is further enhanced by the opposing "S" curve shape of the blades.

It is a further object of the invention to teach a gutter cleaner design that maintains a clear space between the blades. The opening between the two grasping blades contains no cords, wires, springs or other mechanical components which may cause wear and interference or entanglement during pickup of debris. It is a further object of the invention to teach a light weight gutter cleaning apparatus that facilitates ease of use, particularly for two story gutters. The apparatus is strong enough to be temporarily hung on the gutter with the pole attached during a temporary stop by the user or to attend to something during the cleaning.

It is an object of the invention to disclose an apparatus that is constructed of non-conductive composite, Nylon or plastic along with a generic fiberglass extension pole and an actuator cord or rope composed of non-absorbent polypropylene or Nylon. It is a further object of the invention to teach a smooth, uncluttered surface external design that facilitates ease of cleaning and reduces fowling of device by debris.

It is an object of the invention to teach an apparatus constructed of non-corrosive materials that facilitates long life and easy water cleanup. It is a further object of the invention to teach an apparatus having functional operation of the grasping mechanism which is intuitive by design in that tightening the rope tightens the grasp of the blades on the debris and slackening or releasing the rope opens the blades and releases the debris.

These and other objects and advantages of the invention will be set forth, appear in part or become apparent after considering the specification and accompanying drawings. It is to be realized that the following embodiments of the invention have been represented in their simplest form for ease in understanding the invention.

DETAILED DESCRIPTION OF THE INVENTION

Figure 1:
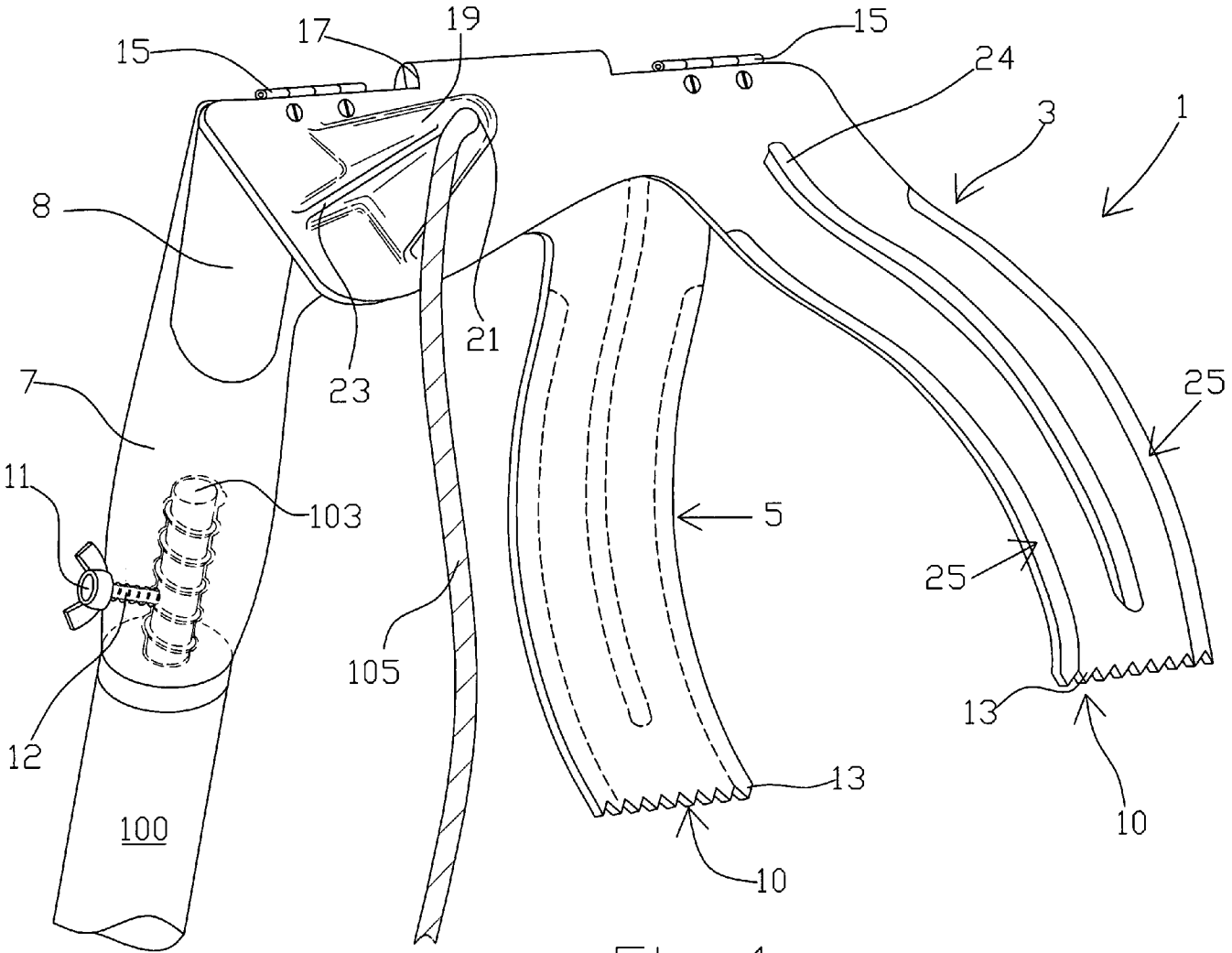
FIG. 1 is a perspective view of the apparatus affixed to a generic extendible pole having a male threaded end.

The embodiments of the invention and the various features and advantageous details thereof are more fully explained with reference to the non-limiting embodiments and examples that are described and/or illustrated in the accompanying drawings and set forth in the following description. It should be noted that the features illustrated in the drawings are not necessarily drawn to scale, and the features of one embodiment may be employed with the other embodiments as the skilled artisan recognizes, even if not explicitly stated herein. Descriptions of well-known components and techniques may be omitted to avoid obscuring the invention. The examples used herein are intended merely to facilitate an understanding of ways in which the invention may be practiced and to further enable those skilled in the art to practice the invention. Accordingly, the examples and embodiments set forth herein should not be construed as limiting the scope of the invention, which is defined by the appended claims. Moreover, it is noted that like reference numerals represent similar parts throughout the several views of the drawings.

Referring now to FIG. 1, the apparatus 1 includes a pair of blades 3, 5 that each comprise a respective tip 10 which includes serrations 13. The serrations 13 may be trimmed from the tips 10 as necessary to shape the operating ends of the device to a round bottomed gutter or other unique shape. Stiffener ridges 24 are arranged along respective tips 10 and extend from the near the upper edge of each blade and downwards towards serrations 13. These stiffener ridges 24 are formed during the molding or extrusion process used in forming each blade. Each tip 10 includes trim lines 25 that may be used as guides to easily cut portions of the tips 10 for modifying the width of tips 10 for different sized gutter troughs. Blade 5 is a fixed blade and includes a receptacle 7 having an open female threaded end for receiving a male threaded end 103, represented in FIG. 1 in broken lines, of an extendible pole 100 as shown. A flat surface 8 is arranged towards movable blade 3 to allow the blades 3, 5 to be fully closed around debris. The receptacle 7 preferably includes internal female threading, also represented in broken lines in FIG. 1, for receiving complementary male threads from end 103 of pole 100. A threaded opening 12 in the sidewall of receptacle 7 accepts a thumb screw 11 for ensuring that the apparatus 1 will not disengage from the extendible pole 100 during operation. As discussed previously, the apparatus 1 and pole 100 are preferably composed of an insulating or dielectric material that electrically isolates the user from any energized power lines that may inadvertently be contacted during use.

Figure 3A:
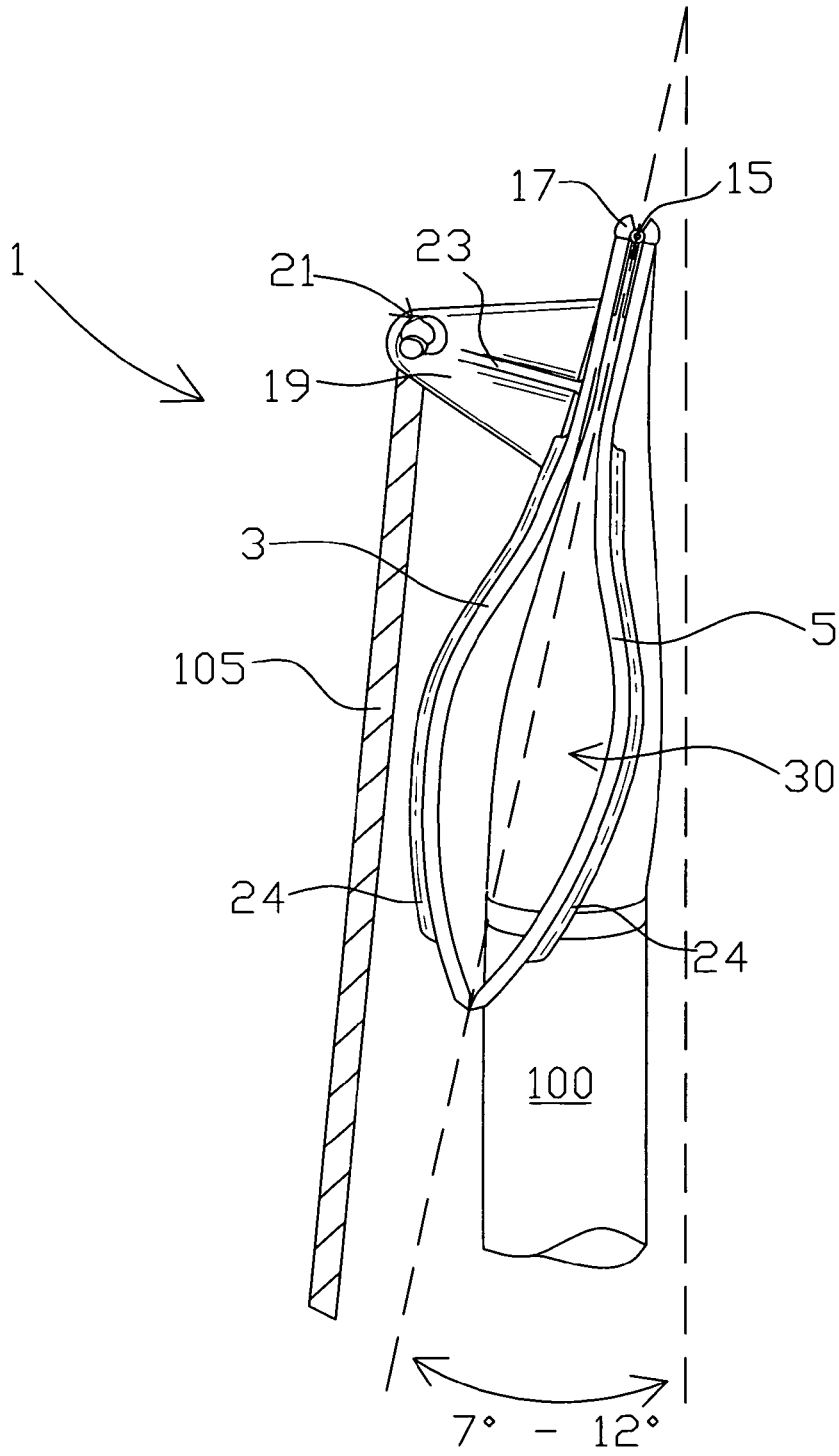
FIG. 3A is a side view of the apparatus shown in the closed position and showing a second preferred angle of blades to the vertical extendible pole axis.
Figure 3B:
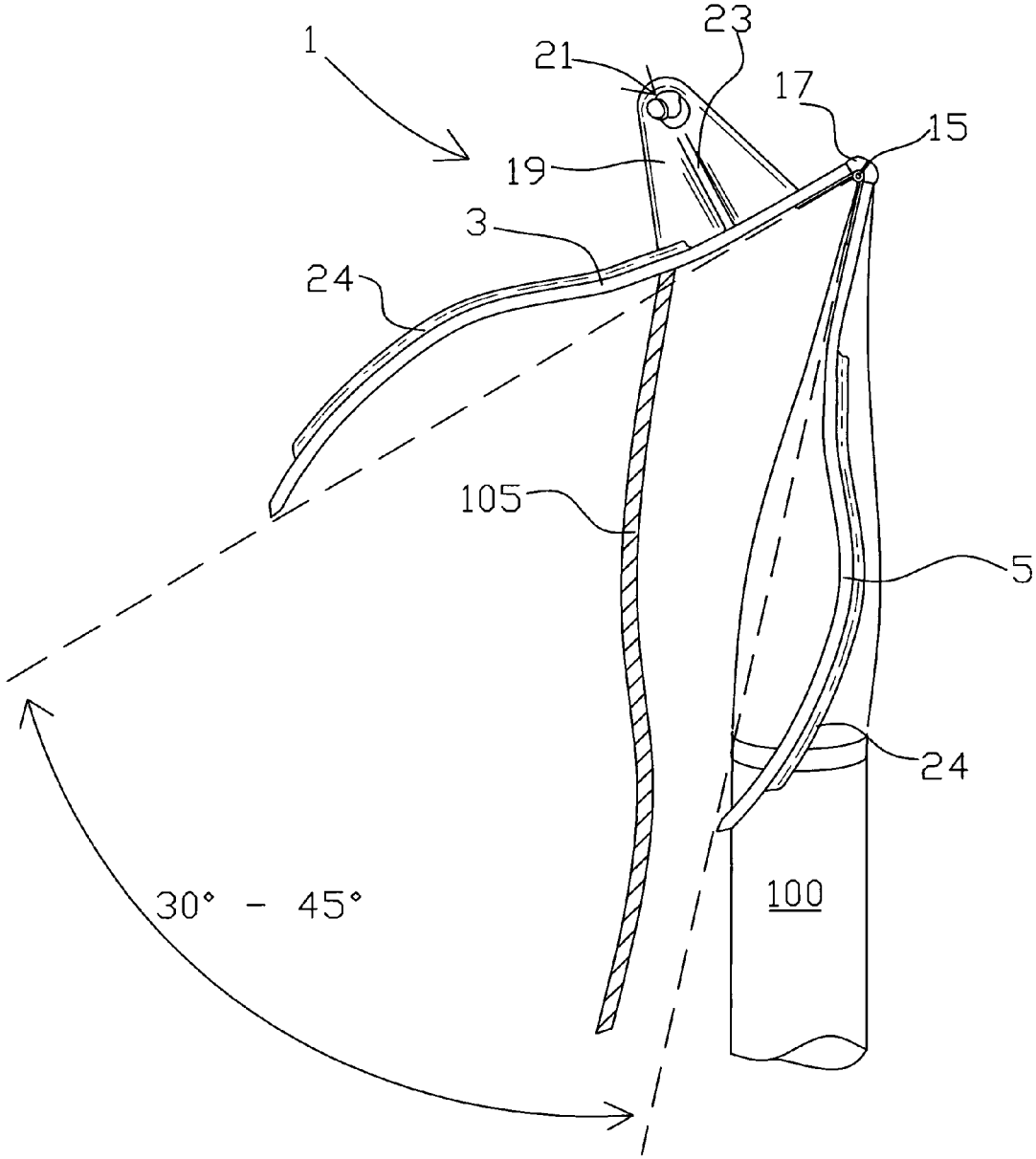
FIG. 3B is a side view of the apparatus shown in the open position with a third preferred angle of opening between blades.

The blades 3, 5 are coupled together via spring hinges 15 such that the maximum angle created between the blades is in a range of substantially between thirty (30) and forty-five (45) degrees as shown in FIG. 3B. Spring hinges 15 are fastened via screws as shown. As can be understood by viewing FIG. 1, countersunk openings in the blades accept the screws to fasten the hinges between the upper ends of the blades. Each blade includes a beveled stop 17 arranged between the spring hinges 15. The pair of beveled stops prohibits the blades from assuming an open position greater than the aforementioned range as can be understood by viewing FIG. 4. It can be understood that the device may be modified to include different angles without deviating from the scope of the invention.

Figure 2:
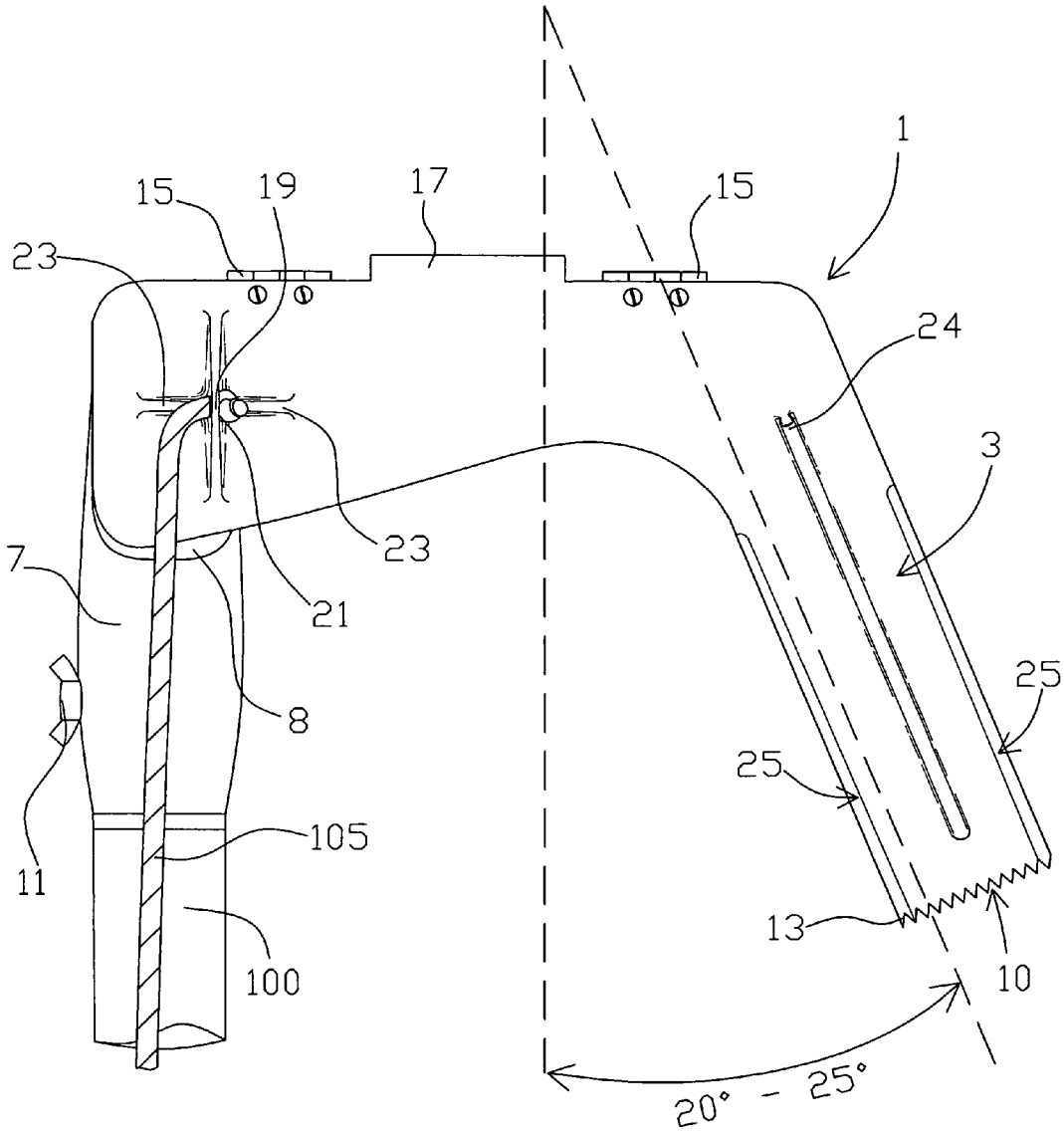
FIG. 2 is a front view of the apparatus and showing a first preferred angle of the blade axis relative to the vertical extendible pole axis.

A lever arm 19 is formed on an exterior surface of blade 3 in the shape of an arrowhead having four sides and comprises a first circular opening 21. The sides 23 extend from the exterior surface of the blade 3 to reinforce the lever arm and ensure that the lever arm 19 will not be damaged during operation of the apparatus 1. The lever arm 19 is preferably cross-shaped when viewed from the distal end as shown in FIG. 2. This shape aids in transferring any force being applied to the lever arm 19 across the entirety of the end of the blade 3 proximal the rope 105. The first opening 21 is preferably round in shape to receive an end of rope 105. A knot to act as a stop is preferably formed in the rope after it passes through the first opening 21. As shown in FIG. 2, the operating ends of the blades 3, 5 preferably form a preferred angle between 20 degrees and 25 degrees with respect to a vertical axis.

As shown in FIG. 3A, the blades 3, 5 have an S-shape when viewed in profile. This S-shape creates a bulbous region 30 between the operating ends 10 of the blades. This bulbous region 30 acts as a temporary containment area with a bottom being the serrated ends of the fixed and movable blades. The device 1 comprises a second preferable angle between a plane intersecting the top and bottom regions between the blades 3, 5 and relative to a vertical axis. This second preferably angle is between seven and twelve degrees as shown.

FIG. 2 shows the apparatus 1 and the preferred angle at which the operating ends 10 are arranged relative to the pole when viewed from the front. As can be understood from FIG. 2 and 3A, the operating ends 10 are arranged preferable angles for proper standoff from the gutter to efficiently operate the device. It can be understood that the device may be modified to include different angles without deviating from the scope of the invention. FIG. 3B shows that the blades 3, 5 when in the open position form an angle of substantially between thirty and forty-five degrees relative to one another.

Figure 4:
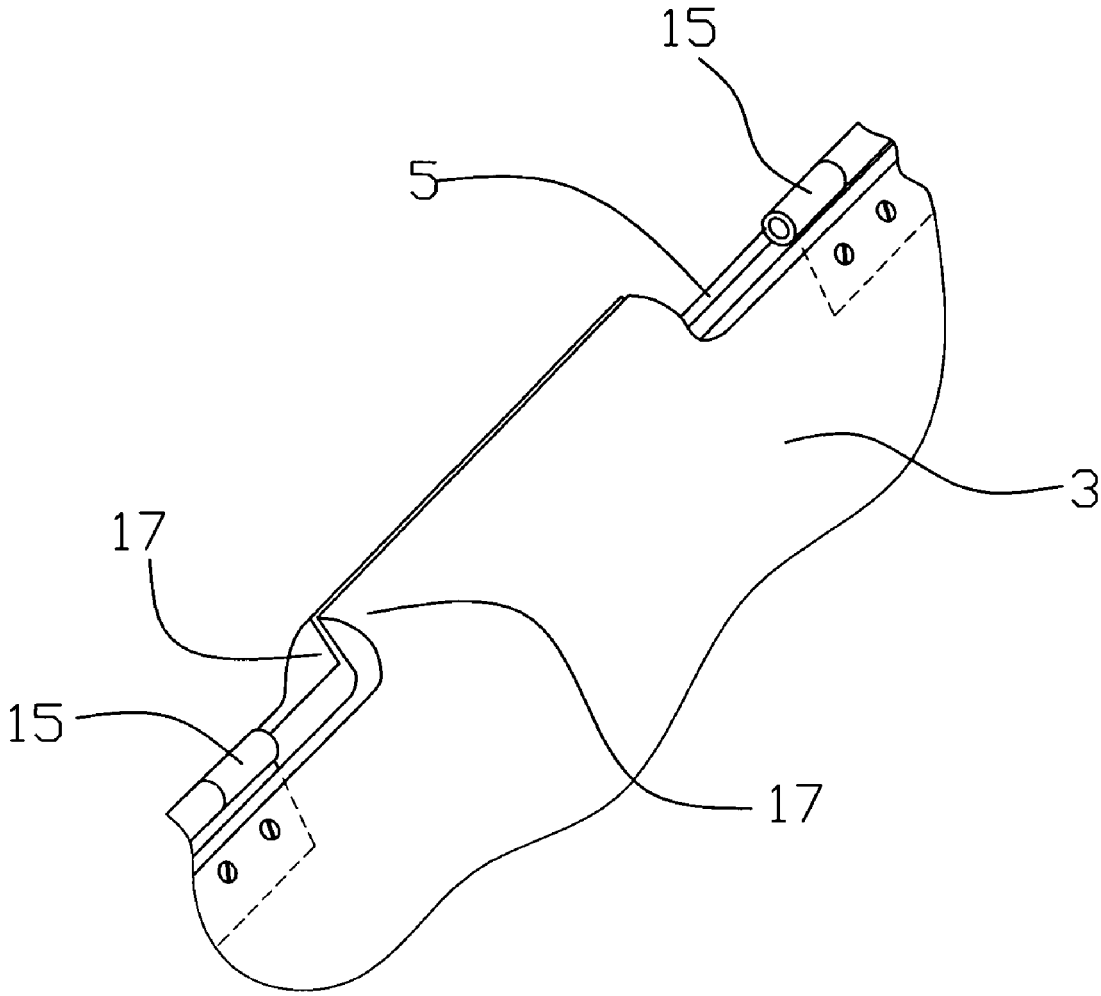
FIG. 4 is an enlarged view of the stops that limit the degree of opening of the blades.

FIG. 4 is an enlarged view of the bevel stops 17 which are arranged along a top edge of each blade 3, 5 between hinges 15. The bevel stops are arranged with flat ends that come together when the apparatus is in an open position, as shown in FIG. 3B. When the apparatus is closed and viewed in profile, the opening between the bevel stops assumes substantially the shape of an open mouth of a Pac-Man icon of the popular video game. When the apparatus is in the open position, an angle assumed between the blades 3, 5 is preferably within a substantial range of between thirty (30) and forty-five (45) degrees. It can be understood that the device may be modified to include different angles without deviating from the scope of the invention. Rolled portions of the bevel stops and flat ends of them are formed during the molding or extruding process.

The gutter cleaning apparatus of the instant invention includes readily replaceable parts as the elements of the apparatus are easily decoupled from the other. The apparatus comprises a pair of inverted L-shaped blades coupled together on a top edge via a pair of spring-biased hinges. The spring-biased hinges include openings for accepting flush mounted blade fasteners that may include nuts, locking washers, and threaded fasteners. In this manner, the blades may be quickly changed should they become worn, simply by disengaging the blades from the hinges using commonly available household tools.

As can be understood, the device is comprised of two opposing blades. One blade is fixed and includes a female threaded receptacle for accepting a male threaded end of an extendible fiberglass or nonconductive pole. A thumb screw opening is provided along the side of the threaded receptacle for accepting a thumb screw that tightens against threads of the extendible pole to prevent loosening or rotation of the device on the threads while in use. Opposing the fixed blade is a movable blade, attached thereto by at least one but preferably two spring hinges.

One or more spring hinges connect the fixed blade to the movable blade, the spring hinges being arranged so as to bias the blades in the open position. The preferred embodiment of the spring hinges is acrylic, Nylon or plastic, attached to the blades by means of common flush type nuts, bolts and lock washers to allow for easy maintenance or blade replacement. The drawings reflect use of two spring hinges. However, it can be readily recognized that a larger spring hinge may be substituted for the two hinges without deviating from the invention.

Blades are preferably arranged at a maximum of thirty (30) degrees to forty-five (45) degrees relative to one another in the biased open position. This maximum angle is maintained by raised beveled stops on the upper blade edges to prevent blade opening more than the optimal angle. It can be understood that the device may be modified to include different angles without deviating from the scope of the invention.

An extension or lever arm, preferably between two (2) and four (4) inches long is attached or formed as part of the movable blade and protrudes from the exterior face of said blade. The arrowhead shaped lever arm is proximately aligned with the axis of the extendible pole. The lever arm includes an opening near the outer edge for accepting one end of the actuator rope or cord which is fastened thereto. The lever arm imparts mechanical advantage that facilitates closure of the movable blade toward the fixed blade and around the debris. The mechanical advantage thus decreases the tension required by the operator when pulling the actuator rope to effect a firm grasp of the debris by the blades. It can be understood that the device may be modified to include a different lever arm length, and shape without deviating from the scope of the invention.

A preset optimal angle of between twenty (20) and twenty-five (25) degrees is maintained between the blades and the extendible pole, as shown in FIG. 2. This angle provides an ergonomically comfortable set-back from the gutter while using the device for rain gutters at both one and two story levels. It can be understood that the device may be modified to include different angles without deviating from the scope of the invention.

Most rain gutters are attached with nails or straps that cross the top of the gutter trough fasten to the soffit fascia. In order to collect gutter debris in piles for pickup, the debris must be moved under the nails or straps. To solve this problem, the gutter cleaner blades are formed at an optimal angle to assist in moving the debris under the gutter nails or straps. When in the closed position and viewed from sides, the axis of the blades are preferably arranged at an angle of seven (7) to twelve (12) degrees relative to the extendible pole. This angle of the blades allows debris to be easily pushed under gutter fasteners such as nails and straps without the need to awkwardly tip the device. It can be understood that the device may be modified to include different angles without deviating from the scope of the invention.

The actuator rope runs roughly parallel from the device along the axis of the extendible pole and serves to close the blades when tension is applied and to open the blades when the rope is released or slackened. The operator pulls down on the lower end of the rope while holding the extendible pole. The tension of the rope is directed to the lever arm to cause the movable blade tip to rotate toward the fixed blade tip. In this manner, the blades and blade tips are moved tightly together and are able to grasp and hold debris located within a rain gutter trough. For electrical safety, the preferred embodiment of the actuator rope is polypropylene or Nylon as these cords are less water absorbent.

Many rain gutters have a very narrow opening between the overhanging shingles and the front edge of the gutter. In the event that a narrow opening is encountered, trim lines are scored or marked on each blade to assist in cutting down the blade width so as to fit in the gutter opening. The blades may be trimmed with a utility knife or heavy duty shears.

The "S" shape blades form an opposing reverse curve with a bulbous opening between the blades at the center area, and lower blade tip edges that close tightly together. This blade shape reduces flexure of the free ends of the blades when closed around heavy debris permitting higher grasping pressure than prior art blades that are flat or near flat in shape. The "S" shape also allows increased debris pickup capacity due to the bulbous space created between the opposing curved blades.

Stiffener ridges extending from the fastened edges of the blade towards the blade tips are provided for stiffening the free ends of the blades such that when the elongated member is pulled downward the blade tips will solidly grasp the debris without excessive flexure of the blade ends.

Lower pickup or operating ends of fixed blade and movable blade are arranged with serrations to facilitate in loosening hard or caked debris in the bottom of the gutter.

The preferred embodiment of the present invention and the generic extendible pole is of non-metallic composite, nylon or plastic that lends itself to ease of manufacture, light weight and dielectric properties.

The smooth lines and simple design of the present invention presents a visually intuitive operation and appealing physical appearance. The aforementioned design attributes facilitate durability and low manufacture cost, safe, efficient, simple operation and ease of cleaning and repair.

Gutter Cleaner Operation

Figure 5A:
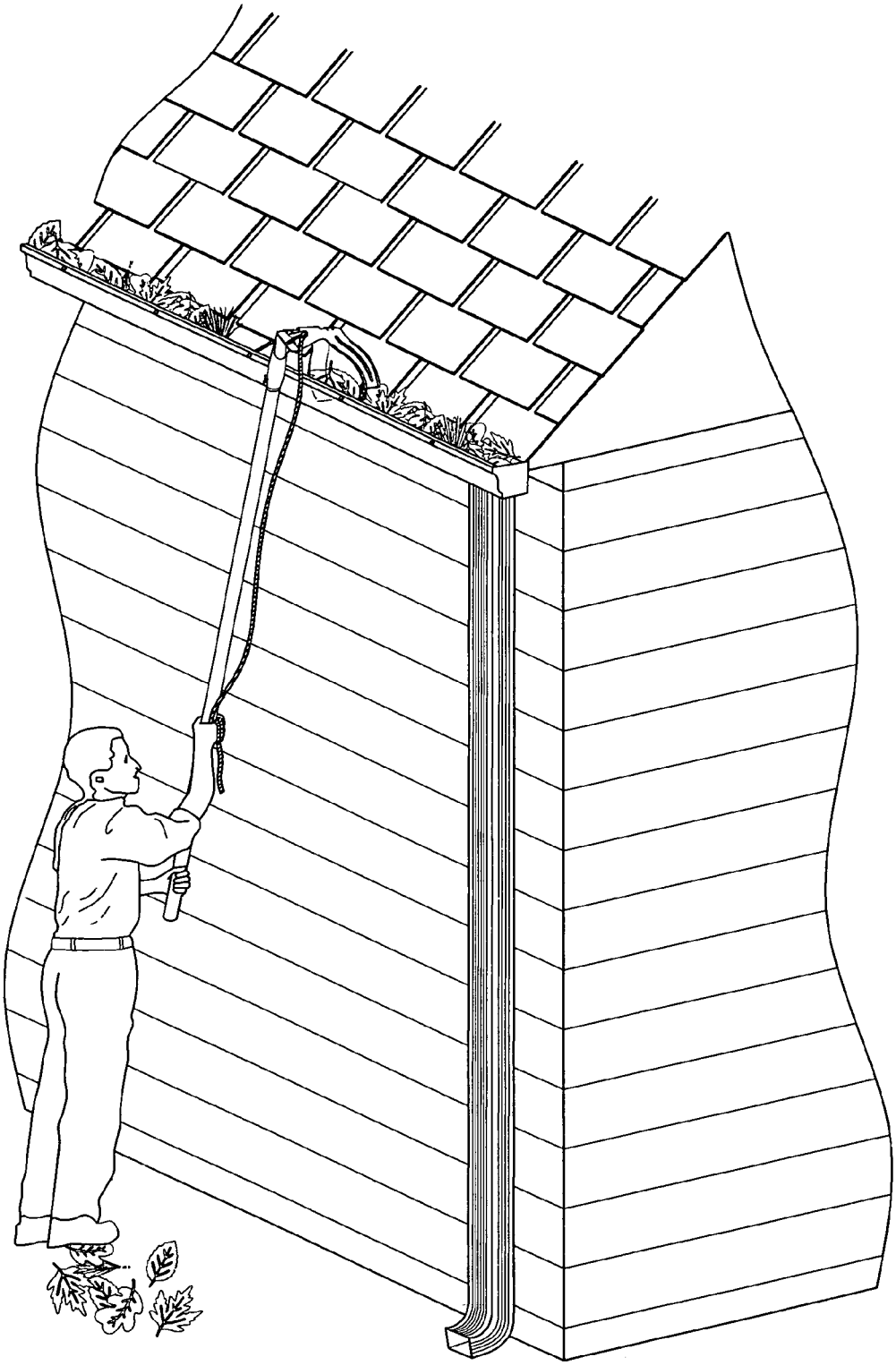
FIG. 5A is a first view of the device in operation showing a user lowering the device into the debris within a gutter.
Figure 5B:
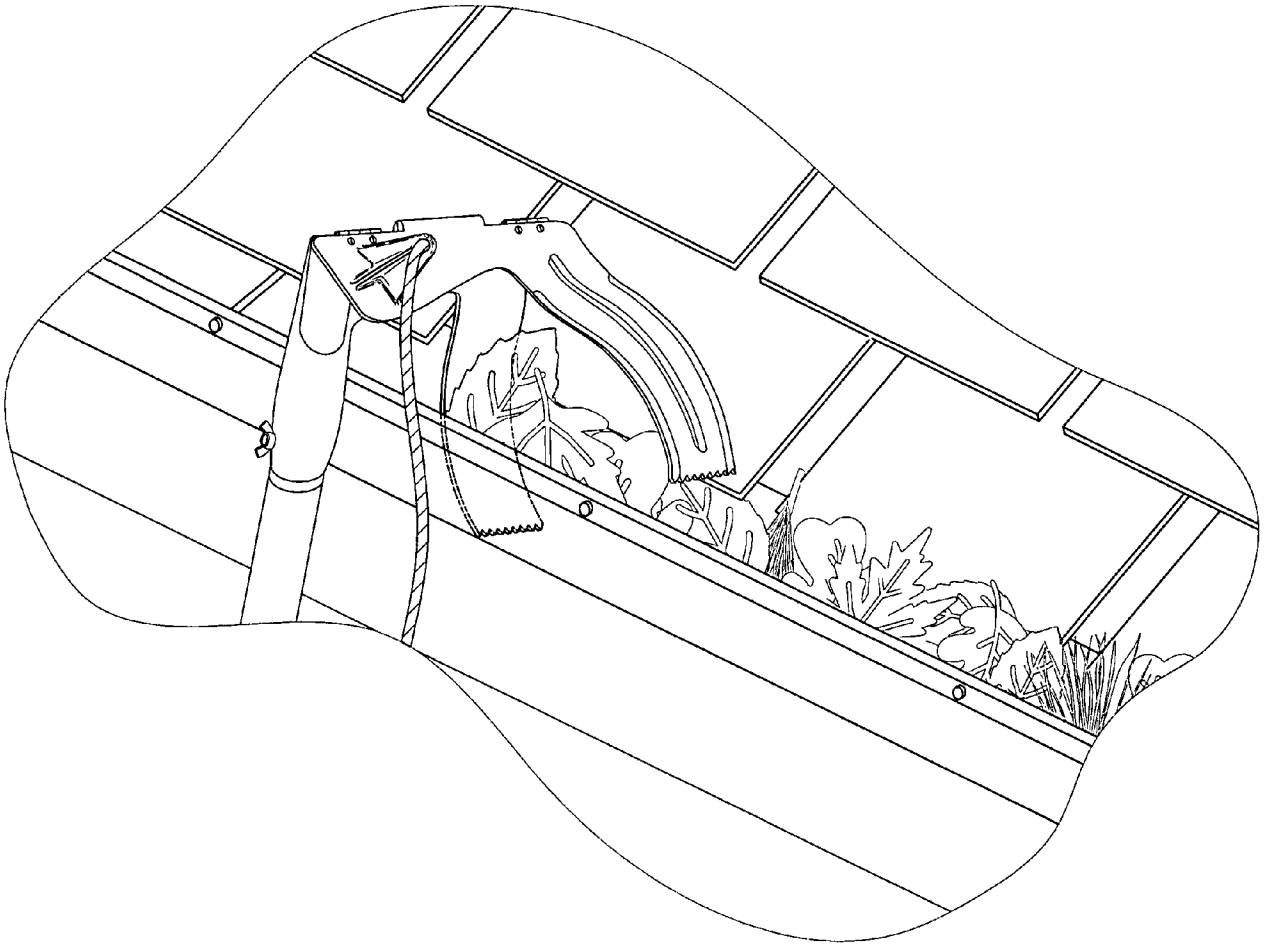
FIG. 5B is an enlarged view of the device arranged above the debris laden gutter.
Figure 5C:
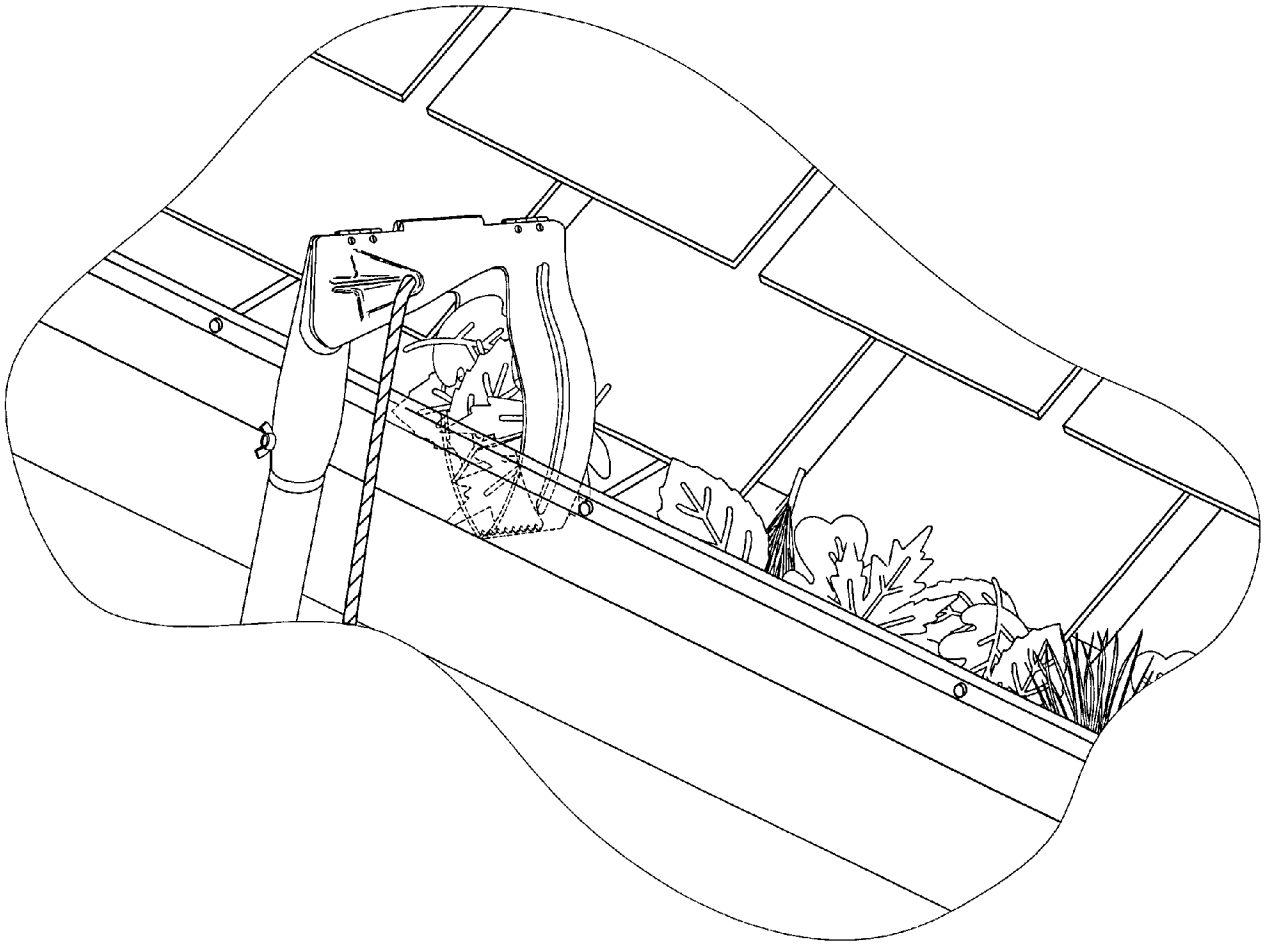
FIG. 5C is a view of the device in operation and grasping the debris.
Figure 5D:
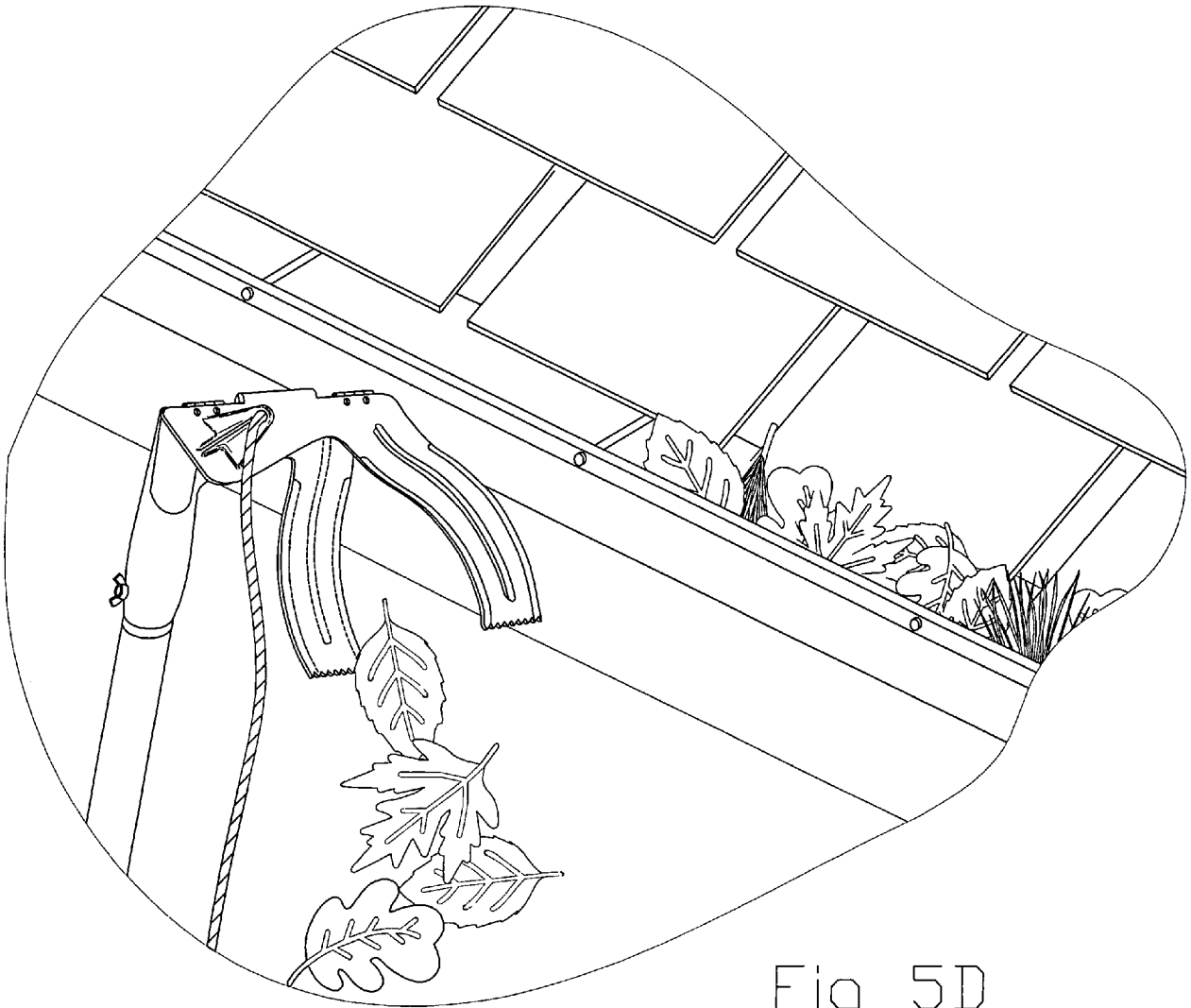
FIG. 5D is a view of the device in operation and releasing the debris that has been removed from the gutter.

FIGS. 5A shows the device being arranged above a debris laden gutter. FIGS. 5B through 5D show the apparatus in operation. Before beginning, the operator should find and note the location of overhead power lines proximate to the gutters. Begin by cleaning the gutter areas directly over the downspout openings. With rope slack, lower the opened blades into the gutter and down into the debris over the downspout opening. Pull and hold the rope to close the blades around the debris, as shown in FIG. 5C. Lift the pole out of the gutter, rotate your body away from the gutter, slacken the rope to open the blades and discharge the debris to the ground, as shown in FIG. 5D. Reinsert the blades into the gutter checking with the blades by feel for toy balls or other large objects partially lodged within the downspout opening. After cleaning over the downspout openings, continue cleaning, beginning at the left end of the gutter and moving from left to right. Slide the blades along the bottom of the gutter from left to right until a pile of debris has accumulated in front of the blades. Lift the pole and blades over and down into the debris and proceed as before to pick up and discharge the debris. When a gutter support strap or nail is reached, the pre-set angle of the in relation to facilitates debris to be pushed under and to the opposite side of the support strap or nail. Repeat the procedure, moving from left to right until completed. For a temporary halt during the cleaning, slide the blades in the gutter near a gutter support strap or nail, slowly release the pole, allowing gutter cleaner and pole to hang from the gutter. As with most tools, eye protection should be used during the cleaning procedure.

While the invention has been described with respect to preferred embodiments, it is intended that all matter contained in the above description or shown in the accompanying drawings shall be interpreted as illustrative and not in limiting sense. From the above disclosure of the general principles of the present invention and the preceding detailed description, those skilled in the art will readily comprehend the various modifications to which the present invention is susceptible. Therefore, the scope of the invention should be limited only by the following claims and equivalents thereof.

I claim:

1. A gutter cleaning apparatus comprising:

a generic extendible, non-conductive pole having male threads at an upper end thereof;

a fixed blade having a threaded receptacle that comprises female threads for attaching to the extendible non-conductive pole;

said fixed blade having a raised beveled edge located along a top edge thereof that acts as a stop;

said fixed blade having a flat surface above the threaded receptacle;

said fixed blade having an operating end that comprises a reverse curve or "S" shape extending to a blade tip thereof;

said fixed blade having a reinforcing or stiffening ridge located along a center exterior side of the operating end extending proximate to said blade tip;

said fixed blade having serrations located at said blade tip of said operating end of the fixed blade to facilitate loosening of hard or caked debris in the bottom of a gutter;

a movable blade opposing the fixed blade and attached thereto, said movable blade having a lever arm arranged on an exterior face thereof and at a side of the movable blade opposite an operating end thereof and in proximate line with the generic, extendible nonconductive pole, an opening being arranged in the lever arm near an end distal said exterior face at an outer end of the lever arm to which an actuator rope is attached; said movable blade having hole openings located along of a top edge thereof, said movable blade having a raised beveled edge located between the pair of hole openings that acts as a stop for the movable blade in the biased open position, said movable blade having an operating end that comprises a reverse curve or "S" shape, said operating end of the movable blade comprising a reinforcing and stiffening ridge located at a center exterior side of the "S" shape, said movable blade having serrations located at an edge of the operating end of the movable blade to facilitate loosening of hard or caked debris in the bottom of a gutter, said movable blade having marked or scored trim lines on the exterior side along the blade outer edges to assist in trimming the blade width should it be necessary;

a blade fastener comprised of at least one spring-biased hinge located at a top edge and between the fixed and movable blades and attaching the blades together to bias the blades toward an open position; and, a rope connected to the lever arm on the moveable blade such that tension may be applied to the rope to rotate the movable blade around the spring-biased hinge thereby closing the operating end of the movable blade tightly against the operating end of the fixed blade.

2. The gutter cleaning apparatus of claim 1 wherein said receptacle of the fixed blade includes a threaded hole at ninety degrees to and located at a center of the female threads to accept a thumb screw.

3. The gutter cleaning apparatus of claim 2 further including a thumb screw arranged in the threaded hole at the center of the female threads and having a length sufficient to reach and tighten against the male threads of the extendible pole.

4. The gutter cleaning apparatus of claim 1 wherein the fixed blade and the movable blade have lightly scored or marked trim lines on the blade edges on exterior sides thereof.

5. The gutter cleaning apparatus of claim 1 wherein the fixed and moveable blades comprise a material selected from a group consisting of non-metallic composite material, Nylon material or plastic material that exhibits resilience and durability and dielectric properties.

6. The gutter cleaning apparatus of claim 1 wherein the spring-biased hinge comprises one or more material selected from a group consisting of acrylic, Nylon and plastic.

7. The gutter cleaning apparatus of claim 1 comprising a pair of spring-biased hinges having two or three mounting holes on each hinge flap.

8. The gutter cleaning apparatus of claim 1 wherein the rope is nominally three eighths of an inch (⅜") in diameter and comprises a material selected from a group consisting of polypropylene and nylon for non-absorbent properties.

9. The gutter cleaning apparatus of claim 1 wherein said lever arm includes side reinforced extensions that are triangular in shape and extending out from the movable blade face so as to strengthen the lever arm and to transfer forces applied to the lever arm across the entirety of the movable blade.

10. The gutter cleaning apparatus of claim 1 wherein said operating ends of the fixed and movable blades, when viewed from the sides, are arranged at an angle to the generic extendible nonconductive pole substantially within a range of angles from seven to twelve degrees to facilitate pushing debris under the gutter support nails or straps.

11. The gutter cleaning apparatus of claim 1 wherein said operating ends of the fixed and movable blades, when viewed from a front or back of the apparatus, are arranged at an angle to the generic extendible nonconductive pole substantially within a range of angles from twenty to twenty-five degrees for proper operating set-back distance.

12. The gutter cleaning apparatus of claim 1 wherein said fixed and movable blades when in the biased open position present an opening between blades substantially within a range of angles from thirty to forty-five degrees for optimal debris pick-up.

13. A gutter cleaning apparatus comprising:

an extendible, non-conductive pole having male threads at an upper end;

a fixed blade having a receptacle that comprises female threads for attaching to the extendible non-conductive pole wherein said receptacle of the fixed blade includes a threaded hole at ninety degrees to and located at a center of the female threads to accept a thumb screw, said fixed blade having a pair of hole openings located along of a top edge of the blade, said fixed blade having a raised beveled edge acting as a stop in a biased open position, said fixed blade having a flat surface above the threaded receptacle that allows full closure of the apparatus, said fixed blade having an operating end that comprises a reverse curve or "S" shape, said operating end comprising a reinforcing and stiffening ridge located at a center exterior side of the "S" shape, said fixed blade having serrations located at an edge of the operating end of the fixed blade to facilitate loosening of hard or caked debris in the bottom of a gutter;

a movable blade opposing the fixed blade and attached thereto with said movable blade having a lever arm arranged on an exterior face thereof and at the side of the movable blade opposite an operating end and proximately at the axis of the extendible pole, said lever arm having a circular opening arranged in the lever arm near an end distal the movable blade at an outer end of the lever arm, said movable blade having hole openings located along of a top edge of the movable blade to accept blade fasteners, said movable blade having a raised beveled edge acting as a stop against an opposing bevel on the fixed blade to limit the open bias of the movable blade with relation to the fixed blade, said movable blade having an operating end that comprises a reverse curve or "S" shape, said operating end of the movable blade having a reinforcing and stiffening ridge located at a center exterior side of the "S" shape, said movable blade having lightly scored or marked trim lines on the blade edges on exterior sides thereof to facilitate trimming the blade if necessary to fit a gutter opening said movable blade having serrations located at the lower edge of the operating end to facilitate loosening of hard or caked debris in the bottom of a gutter;

blade fasteners comprised of at least one spring hinge arranged against respective hole openings coupling the fixed blade to the movable blade, said at least one spring hinge being located at a top edge and between the fixed and movable blades and attaching the blades together so as to bias the blades towards an open position; and, a rope connected to the lever arm on the moveable blade such that tension may be applied to the rope to close the operating ends of the fixed and movable blades together.

14. The gutter cleaning apparatus of claim 13 further including the fixed blade and the movable blade having lightly scored or marked trim lines on the blade edges on an exterior sides thereof.

15. The gutter cleaning apparatus of claim 13 wherein the fixed and moveable blade comprise a material selected from a group consisting of non-metallic composite material, Nylon material or plastic material that exhibits resilience, durability and dielectric properties.

16. The gutter cleaning apparatus of claim 13 wherein the spring hinge comprises one or more material selected from a group consisting of acrylic, Nylon and plastic.

17. The gutter cleaning apparatus of claim 13 wherein the spring hinge includes two or three mounting holes.

18. The gutter cleaning apparatus of claim 13 wherein the rope is nominally three eighths of an inch (⅜") in diameter and comprises a material selected from a group consisting of non-absorbent fibers such polypropylene and nylon.

19. The gutter cleaning apparatus of claim 13 wherein said lever arm includes a side reinforced extension that is triangular in shape so as to transfer forces applied to the movable lever arm across the entirety of the movable blade.

20. The gutter cleaning apparatus of claim 13 wherein said operating ends of the fixed and movable blades, when viewed in profile, are arranged at an angle to the extendible nonconductive pole substantially within a range of angles from seven to twelve degrees.

21. The gutter cleaning apparatus of claim 13 wherein said operating ends of the fixed and movable blades, when viewed from a front or back of the apparatus, are arranged at an angle to the extendible non-conductive pole substantially within a range of angles from twenty to twenty-five degrees.

22. The gutter cleaning apparatus of claim 13 further comprising a thumb screw arranged in the threaded hole at the center of the female threads and having a length sufficient to reach the male threads of the extendible pole.

23. The gutter cleaning apparatus of claim 13 wherein said fixed and movable blades are biased in an open position when actuator rope is slackened, said blades being optimally open between thirty and forty-five degrees as determined by the beveled blade stops.

24. The gutter cleaning apparatus of claim 13 wherein the blades are arranged to be biased in the open position at an angle of thirty to forty-five degrees between the blades.

25. The gutter cleaning apparatus of claim 13 wherein each blade has a reverse curve or "S" shape such that when in the closed position, a bulbous opening is created between the fixed and movable blades and a horizontal opening between the blades at the bulbous opening is substantially one to two inches wide for optimal debris pickup capacity.

26. The gutter cleaning apparatus of claim 13 comprising an assembly, mounted on a generic extendible pole that will permit a user, standing at ground level, to collect and remove debris clogging roof rain gutters and downspout openings on a typical one or two story structure.

* * * * *